US012486646B2

(12) United States Patent
Ott et al.

(10) Patent No.: US 12,486,646 B2
(45) Date of Patent: Dec. 2, 2025

(54) METHOD AND DEVICE FOR MEASURING THE PERFORMANCE OF AN EARTH-MOVING MACHINE IN SOIL, AND EARTH-MOVING MACHINE COMPRISING A DEVICE OF SAID TYPE

(71) Applicant: SODEX INNOVATIONS GMBH, Tschaggungs (AT)

(72) Inventors: Raphael Ott, Tschagguns (AT); Ralf Pfefferkorn, Tschagguns (AT); Bernhard Gantner, Tschagguns (AT)

(73) Assignee: Sodex Innovations GmbH, Tschagguns (AT)

( * ) Notice: Subject to any disclaimer, the term of this patent is extended or adjusted under 35 U.S.C. 154(b) by 45 days.

(21) Appl. No.: 18/702,925

(22) PCT Filed: Oct. 19, 2022

(86) PCT No.: PCT/EP2022/079066

§ 371 (c)(1),
(2) Date: Apr. 19, 2024

(87) PCT Pub. No.: WO2023/066978

PCT Pub. Date: Apr. 27, 2023

(65) Prior Publication Data

US 2025/0250771 A1 Aug. 7, 2025

(30) Foreign Application Priority Data

Oct. 20, 2021 (AT) ..... A 60263/2021

(51) Int. Cl.
*E02F 9/26* (2006.01)

(52) U.S. Cl.
CPC ..... *E02F 9/261* (2013.01); *E02F 9/264* (2013.01)

(58) Field of Classification Search
CPC ..... E02F 9/00; G06V 10/00; G06V 20/00
See application file for complete search history.

(56) References Cited

U.S. PATENT DOCUMENTS

| | | | | |
|---|---|---|---|---|
| 6,201,883 | B1 | 3/2001 | Mizui | |
| 11,157,849 | B2 | 10/2021 | Shike | |
| 11,783,248 | B2 | 10/2023 | Shike et al. | |
| 12,364,181 | B2 * | 7/2025 | Anderson | B60W 50/14 |
| 2018/0137446 | A1 * | 5/2018 | Shike | G06Q 50/08 |
| 2018/0163376 | A1 * | 6/2018 | Redenbo | E02F 9/262 |
| 2018/0218304 | A1 * | 8/2018 | Shike | G06Q 10/0631 |

FOREIGN PATENT DOCUMENTS

| | | | |
|---|---|---|---|
| DE | 112016002851 | T5 | 3/2018 |
| DE | 112016003423 | T5 | 5/2018 |
| JP | 2002328022 | A | 11/2002 |

* cited by examiner

*Primary Examiner* — Maryam A Nasri
(74) *Attorney, Agent, or Firm* — Laurence A. Greenberg; Werner H. Stemer; Ralph E. Locher

(57) ABSTRACT

A method and a device measure the performance of an earth-moving machine in soil as well as to an earth-moving machine containing a device of this type. The working performance resulting from earth movements of such a machine, in particular while the earth-moving machine is still in operation, can be determined. In this way, it is possible to record and bill the work carried out with the earth-moving machine.

19 Claims, 3 Drawing Sheets

METHOD AND DEVICE FOR MEASURING THE PERFORMANCE OF AN EARTH-MOVING MACHINE IN SOIL, AND EARTH-MOVING MACHINE COMPRISING A DEVICE OF SAID TYPE

FIELD AND BACKGROUND OF THE INVENTION

The invention relates to a method and a device for detecting the working performance of such an earth-moving machine within a subsoil, and to an earth-moving machine comprising such a device.

Earth-moving machines are used to loosen, load, transport, install and compact earth masses or bulk materials over short distances. The machines are equipped with different undercarriages and attachments for earthmoving work. A basic distinction is made between stationary, wheeled, flat and suction excavators for earth-moving machines. The present invention relates to such earth-moving machines.

A number of assistance systems for earth-moving machines that are also capable of measuring the subsoil are known from the state of the art. The disadvantage of this is that there is as yet no assistance system for earth-moving machines that can neither carry out an optical measurement of the subsoil nor determine the working performance of such a machine and indirectly the resulting costs for the earth movements during operation of the earth-moving machine.

SUMMARY OF THE INVENTION

It is therefore the object of the present invention to provide a method, a device and an earth-moving machine, by means of which the working performance resulting from the earth movements of such a machine—in particular while the earth-moving machine is still in operation—can be determined. In this way, it should be possible to record and bill the work carried out with the earth-moving machine more easily and with less effort than before, so that the billing of the working performance carried out with the earth-moving machine can be simplified.

The object is solved by a method, a device and an earth-moving machine according to the independent claims. The dependent claims describe particularly useful embodiments of the invention.

A method according to the invention for detecting the working performance of an earth-moving machine within a subsoil, comprises the following steps:

a) Detecting the topography of the original subsoil—original terrain—before or at the start of earth movements using the earth-moving machine;
b) Detecting the changing topography of the subsoil—actual terrain—as a result of earth-moving operations during the execution of earth movements using the earth-moving machine;
c) Carry out step b) until a specified topography of the subsoil is reached—target terrain;
d) Comparing the original terrain with the actual terrain to record the earth movements already carried out with the earth-moving machine; or
e) Comparing the original terrain with the target terrain to detect all earth movements made with the earth-moving machine on the subsoil to create the target terrain; or
f) Comparing two different detected actual terrains to detect the earth movements already made between them with the earth-moving machine;

g) Determining the working performance of the earth-moving machine as a function of the comparison from step d) or e) or f);
h) wherein the original terrain or the actual terrain is detected in steps a) to c) by means of topography sensors, such as cameras, preferably 3D cameras, such as TOF cameras or PMD cameras, radar or lidar systems, which are attached to the earth-moving machine.

For the purposes of the invention, the term working performance is understood to mean a volume of work performed within a working time by means of the construction equipment. The work volume can be characterized by a volume of earth removed by the earth-moving machine, also called excavation, or by a volume of earth added to the subsoil, then called backfill. In other words, the working performance can be characterized by the volume of excavation or backfill on the one hand and by the actual physical work performed by the earth-moving machine on the other. The working performance can then be used to indirectly determine costs, such as the fuel costs required to perform the work or the disposal costs of the excavated material produced by the earth-moving machine on the subsoil.

The original terrain is the environment as it looked before the earth-moving machine began its work. The topography of the subsoil can be detected using appropriate topography sensors. These are used to scan the subsoil while the earth-moving machine is moving or working on the subsoil. This allows the original terrain, i.e. the subsoil, to be reconstructed or recorded. This can be done before or at the start of the earthworks using the topography sensors of the earth-moving machine. The first scanned points, which are not classified/deleted as scatter points, at a certain position ultimately result in the original terrain.

The actual terrain is the current appearance of the surroundings and is always detected (continuously) based on the current scan of the subsoil. This means that in the course of the present invention, several actual terrains are detected (recorded) one after the other in chronological sequence. This is done by means of corresponding, successive scans using the topography sensors. Preferably, components that are disruptive, such as parts of the earth-moving machine, building material or people, can be filtered out of the data. This can be done using the data generated by the topography sensors, such as cameras, which recognize objects that should not or must not be detected. In order to keep the error deviation as low as possible, scattering errors from the topography sensors can also be filtered out by comparing the data with the data already stored and not storing data that deviates significantly. Areas of the subsoil in which no changes have been made using the construction equipment (can be determined by the vehicle sensors) and only deviate slightly from previously stored data are continuously averaged in order to achieve even higher accuracy. The scans of the actual terrain, which are detected continuously, i.e. one after the other, show the subsoil in the individual phases of excavation or backfilling by the earth-moving machine. This allows the excavation or changes to the terrain to be displayed over time and the work process to be analyzed. This can be done by comparing the point clouds of the terrain (original, actual, target terrain) but also by comparing the data from the topography sensors, such as camera images. The topography sensors, such as cameras, can also be used to document the working performance, to increase the efficiency of the work carried out with the earth-moving machine and to validate the measurements, e.g. the measured values using the other topography sensors, such as lidar systems, using point clouds. In this case, therefore, at least one camera and at least one lidar system, for example, are provided as topography sensors for optical measurement of the subsoil.

By means of the invention, construction sections can also be examined or evaluated with regard to working performance by carrying out the comparison according to the invention between two different actual terrains, e.g. those which are disturbed at different times and recorded consecutively, in particular of the same job, i.e. to carry out the work necessary to achieve the target terrain.

Target terrain is a predetermined topography of the subsoil that is to be achieved by the earth-moving machine. It is the result to be achieved by the earthworks. The target terrain can, for example, be a predetermined 3D model of the subsoil with a completed excavation pit. Ideally, the target terrain then corresponds to the last scanned actual terrain immediately after completion of the earth movements using the earth-moving machine. Thus, instead of the target terrain, the actual terrain recorded by the topography sensors can also be used for the comparison according to the invention.

It is also possible for the operator to enter the current soil classification via an input tool, as different soil materials can be billed differently. The system always links the input with the respective quantity or environment that is being processed during the time in which a parameter is set. This makes it possible to determine exactly which quantity of which soil material was excavated. In addition, different tools or configurations of the machine itself can also be set, as this also requires different billing. For this purpose, the device according to the invention can be set up in such a way that the input of the current soil classification is made, for example, by the operator of the earth-moving machine while the earth-moving work itself is still in progress. In this way, the material actually removed (excavation) or the material added to the subsoil (backfill) can be recorded.

The data thus obtained by the topography and/or vehicle sensors during operation of the earth-moving machine can be used after completion or during the work as follows:

- Settlement based on the comparison of actual and original terrain
- Settlement based on the respective quantities of the respective soil material (layer structure of the soil) and machine configurations, as the earth's crust is known to be made up of several layers
- Analysis of the actual terrain based on the scanned data
- During work, the target terrain or a comparison of the actual terrain with the target terrain can also be imported into the earth-moving machine, for example, and shown on an output tool (e.g. display, virtual or augmented reality) so that the operator can operate more accurately based on the comparison of the target and actual terrain
- Forwarding the quantities of soil material e.g. to landfills, via a wireless radio network or the mobile phone network
- Tracking progress based on the actual terrain The invention, which is mounted on construction machinery such as excavators or caterpillars, can be used to constantly measure the terrain using lidar or radar systems. An additional camera unit can be used to record images of the construction site. The number of topography sensors, i.e. 3D scanner, radar or camera, is flexible and varies depending on the area of application. The invention thus allows the terrain to be constantly surveyed by the earth-moving machine itself during the earthworks. The resulting 3D model of the terrain (actual terrain) is georeferenced using additional vehicle sensors on the earth-moving machine, which measure the position and joints, as well as a GPS system. Finally, an image of the actual terrain is created at any time during the earthworks. This can be sent to the office in real time, for example, without an additional evaluation unit, such as a computer unit on the construction site, or shown to the machine operator on a display in the earth-moving machine. By driving over the terrain with the earth-moving machine before construction work, the original terrain can also be recorded as a 3D model.

When, in accordance with the present invention, reference is made to earth movements or earthworks, this means, on the one hand, an excavation, i.e. the soil that can be removed from the subsoil, as part of the earth's crust, irrespective of the material (e.g. peat, clay, sand, rock) of which this consists. On the other hand, the terms mentioned at the beginning also include backfilling of the material in question.

Preferably, the comparison in step d) or e) or f) of the method according to the invention is carried out by calculating the volume which the original terrain limits with the actual terrain, the original terrain limits with the target terrain or between two different actual terrains (e.g. one earlier and one later in time) in a Cartesian coordinate system with the same zero point, so that the working performance is determined as a function of the total volume of earth actually removed from or moved with the subsoil by means of the earth-moving machine. In other words, the subsoil is first measured before (original terrain), then continuously during (actual terrain) until the earth movements are completed using the earth-moving machine. The measurements can be used to create a corresponding 3D model of the original terrain and the respective actual terrain. The raw data recorded by the sensors can also be output in the form of point clouds. The 3D model can also be converted into a corresponding CAD format and then imported into corresponding CAD systems for evaluation. Corresponding views on or cross-sections through the 3D model can also be created from the 3D model and output (e.g. to the aforementioned output tool or a user tool) for a more detailed analysis of the working performance. The user tool can be a computer-based system decoupled from the earth-moving machine, such as a (cloud) database system, to which the topographies of the original, actual and target terrain can be transferred from the earth-moving machine via a wireless radio network or the mobile phone network. By superimposing the 3D models in a Cartesian coordinate system with the same zero point and then subtracting the individual coordinates of the points of the point clouds of the superimposed 3D models, the volume enclosed or bounded by them can be calculated.

The Cartesian coordinate system can be a local coordinate system, preferably of the earth-moving machine, or a world coordinate system in which the earth-moving machine moves.

The original terrain (U), the actual terrain (I) or the target terrain (S) recorded by topography sensors (2), such as cameras, preferably 3D cameras, such as TOF cameras or PMD cameras, radar or lidar systems, can be available as a georeferenced polygon mesh or point cloud. The topography sensors, such as cameras, preferably 3D cameras, such as TOF cameras or PMD cameras, radar or lidar systems, are well-known, proven and comparatively inexpensive systems.

At least one attribute can be assigned to at least one predetermined point of the polygon mesh or at least one predetermined point of the point cloud, which describes a property, in particular a property of the earth-moving machine, such as the identification of the earth-moving machine or the actual terrain (I), such as the soil composition or the rock classes of the volume of earth to be removed or its color values, the time of recording or the measurement accuracy, whereby the at least one attribute is preferably recorded by means of the topography sensors. This means that the captured 3D model, which is available as a polygon mesh or point cloud, has parameter options that can be expanded into a BIM model (Building Information Model). The parameters can be added to an existing 3D model subsequently or directly during the surveying (i.e. the earthworks) and creation of the digital image of the site. For example, the parameters or attributes can be rock classes. This allows the rock class to be added to the point cloud during the earthworks. This is either selected manually on the display of the earth-moving machine and entered by the operator or optically detected by the installed topography sensors, such as camera systems, or detected by reflections from the lidar system and then automatically added as an attribute to the corresponding point in the point cloud or polygon mesh. As the rock classes vary during the work, the rock class can also be changed several times in a 3D model, so that multiple entries by the operator are required. Finally, a point cloud is generated, which can be subdivided into the respective rock classes. The cameras attached to the earth-moving machine and the lidar system can also be used to color the point clouds based on the colors of the terrain captured by them, so that a color value is added to the corresponding point as an attribute. By fusing the sensor values, the point cloud also reflects the color of the terrain by means of an additional RGB value per point. The operator can thus identify the colors on the 3D model that correspond to the colors of the terrain in reality. The display in the earth-moving machine can also be used to store other parameters of the surveying system during earthworks. Project and construction phases, which describe the current construction process, can also be stored so that the point cloud can be broken down retrospectively in the same way as with rock classes. The time, construction machine, notes etc. can also be stored in the 3D model during the creation of the 3D model. In this way, meta-information can be stored as attributes, as they are also stored in the BIM model, to the points of the point cloud or polygon mesh.

Advantageously, the movements of the earth-moving machine above the subsoil and movements of the earth-moving machine itself or parts thereof, such as booms, can be detected by means of vehicle sensors, such as inclination or position sensors, which can preferably be mounted on parts of the earth-moving machine, such as the boom, whereby preferably these movements are also used to determine the working performance of the earth-moving machine. For example, it is possible to arrange such vehicle sensors on each joint of the boom of the earth-moving machine. The sensors can be set up in such a way that they can also be retrofitted to any known earth-moving machine. The kinematic chains of all joints (or the tip of the earth-moving machine's bucket) and the history of all movements of the earth-moving machine or parts thereof can be recorded on the basis of mathematical calculations. By attaching the vehicle sensors to the earth-moving machine, the movement of all parts of it can be recorded particularly easily. The vehicle sensors record the movement, position and, if applicable, the operating status of the earth-moving machine. Inclination sensors can be used to record the movement and position of the individual joints of the earth-moving machine or parts of it, such as the boom, arm, stick and uppercarriage. The position of all components, joints and connections can be determined in the local coordinate system. The local coordinate system can have the zero point in the center of the earth-moving machine. These values can also be recorded using rotary encoders, incremental encoders (absolute and relative), proximity switches, laser measuring devices or similar.

A vehicle sensor is also a sensor that is part of a global navigation satellite system (GNSS, such as GPS, GALILEO or GLONASS).

The movements of the earth-moving machine can be recorded while the topography of the original terrain or the actual terrain is being detected (i.e. at the same time). This means that the movements of the earth-moving machine and the topography of the subsoil are detected simultaneously.

Preferably, the vehicle sensors as well as the topography sensors can be attached to the earth-moving machine so that the actual terrain is recorded from different positions and orientations, whereby the vehicle sensors and the topography sensors can preferably be attached to parts of the earth-moving machine, such as the boom. By positioning the topography sensors on the earth-moving machine, the topography of the subsoil is recorded automatically, i.e. during the earthworks (earth movements) using the earth-moving machine. The data recorded by the vehicle sensors can be used to advantageously transfer the detected topography (original terrain, actual terrain, target terrain) of the subsoil from the local coordinate system of the earth-moving machine into the world coordinate system. This is done, for example, by means of kinematic chains such as forward kinematics, e.g. using the Denavit-Hartenberg transformation.

The method can be used to indirectly deduce the costs actually incurred by the earth-moving machine as a result of carrying out the earth movements from the working performance determined. For example, when an excavation pit is dug using the earth-moving machine, the actual costs incurred for this work can be deduced from the working performance. The finished excavation pit no longer needs to be measured by hand, as this is done indirectly while the earth-moving machine carries out the necessary earth movements.

The invention also relates to a device for detecting the working performance of an earth-moving machine within a subsoil, comprising at least one, preferably a plurality of topography sensors, such as cameras, preferably 3D cameras, such as TOF cameras or PMD cameras, radar or lidar systems, a plurality of vehicle sensors, such as inclination or position sensors, wherein the topography sensors and/or the vehicle sensors are preferably mounted or can be mounted on parts of the earth-moving machine, such as the boom of the earth-moving machine, and an evaluation unit which is connected or can be connected to the topography sensors and the vehicle sensors and is set up in such a way that it carries out a method according to the invention.

The evaluation unit can be arranged or is arrangeable outside the earth-moving machine and can be connected or is connectable to the topography sensors and the vehicle sensors of the earth-moving machine via wireless communication channels, whereby the evaluation unit can be connected or is connectable to the topography and vehicle sensors via corresponding communication channels (wired or wireless). Wireless communication channels can be mobile radio communication channels of mobile radio standards such as LTE, 5G. The topography and vehicle sensors can be connected or is connectable to the evaluation unit via a communication unit, comprising a transmitter and a receiver, in order to transmit the values recorded by the topography and vehicle sensors to the evaluation unit, whereby the communication unit can be attached to the earth-moving machine. The evaluation unit can be a computer, PLC (programmable logic controller), microcontroller, industrial PC or any other type of computing unit. Preferably, the evaluation unit is a cloud computer in a data center. It receives the data either directly or via an adapter module from the vehicle and topography sensors.

The device according to the invention can be set up in such a way that it can be retrofitted to already known earth-moving machines and is preferably set up in such a way that it works independently of the vehicle control of the earth-moving machine.

The device can transmit the data recorded by topography or vehicle sensors or the results of said comparison to a user tool for further evaluation via a wireless radio network or the mobile phone network.

The invention also relates to an earth-moving machine comprising a device according to the invention for detecting its working performance. The earth-moving machine can preferably be a stationary excavator, such as a hydraulic excavator, a mobile excavator, such as a wheel loader, a backhoe loader or a crawler loader, a flat excavator, such as a bulldozer, grader, dragline or scraper.

When it is mentioned that the topography or vehicle sensors can be attached to the earth-moving machine or its parts, it is also meant that the earth-moving machine or its parts also include attachments such as shovels or drills.

A method for retrofitting a device according to the invention to existing earth-moving machines, which is free of such a device, comprises the following steps: a) applying the plurality of vehicle sensors and at least one, preferably a plurality of topography sensors to the earth-moving machine, in particular to its parts, such as booms; b) installing an evaluation unit of the device in the earth-moving machine, e.g. in its interior; c) connecting the vehicle and topography sensor(s) to the evaluation unit via communication channels.

The advantages of the invention will now be illustrated in more detail with reference to a preferred embodiment and the figures.

DETAILED DESCRIPTION OF THE INVENTION

Figure 1:
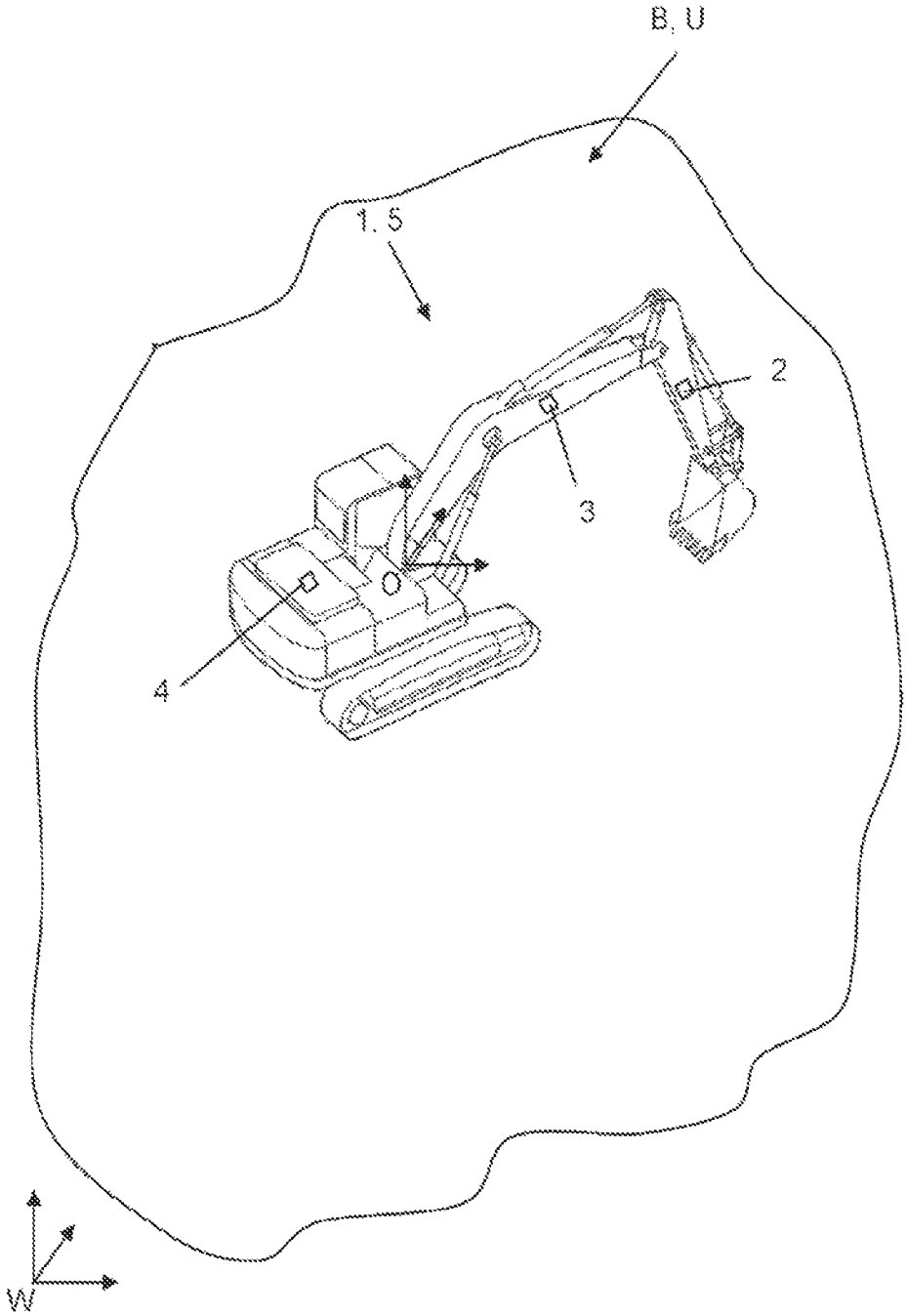
FIG. 1 a schematic view of an earth-moving machine moving on a subsoil at or before the start of the earthworks.
Figure 2:
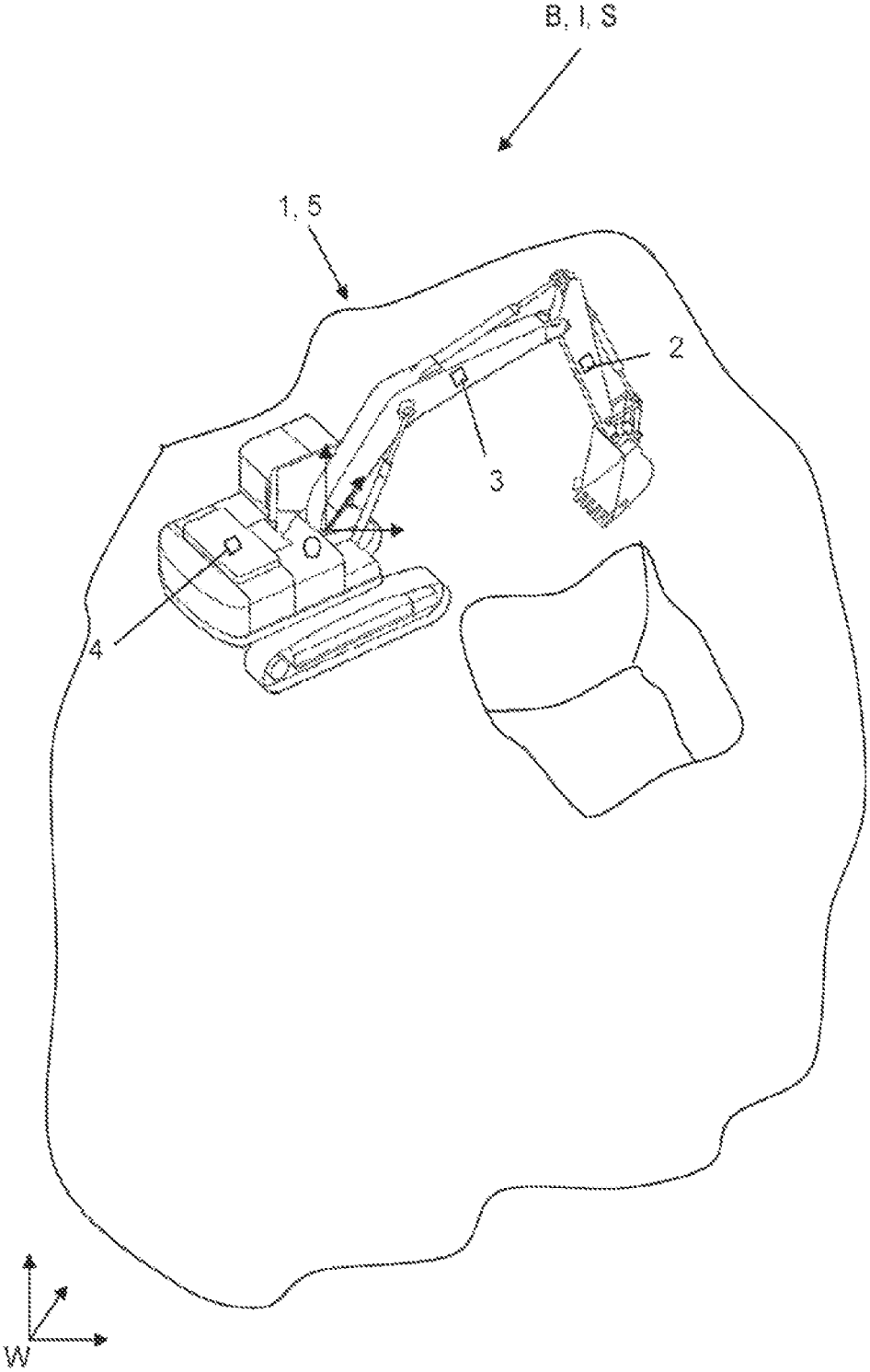
FIG. 2 a schematic view of an earth-moving machine moving on a subsoil before or after completion of the earthworks.

FIGS. 1 and 2 each show a schematic view of an earth-moving machine 1 on a subsoil B to be worked by the earth-moving machine 1. FIG. 1 shows the state of the subsoil B in its original state, referred to as the original terrain, in which no earth movements have yet been carried out by the earth-moving machine 1. In the present case, the earth-moving machine 1 is designed as an excavator, such as a hydraulic excavator, and comprises a device 5 for detecting (recording) the working performance of the earth-moving machine 1. This device 5 comprises an evaluation unit 4, which is equipped with several vehicle sensors 3 and at least one topography sensor 2 for recording the topography of the subsoil B via communication lines not shown. The vehicle sensors 3 and the at least one topography sensor 2 are arranged on the boom of the earth-moving machine 1. The vehicle sensors 3 can detect the movements of the earth-moving machine 1 over the subsoil and the movements of the earth-moving machine 1 itself or parts thereof, such as the boom or individual joints thereof. The at least one topography sensor 2 continuously scans the subsoil B for its changes, i.e. as a result of the earth movements of the earth-moving machine 1 itself.

This creates a scan or 3D model of the original terrain. This can be done when the operator of the earth-moving machine 1 starts work, i.e. when he turns the ignition key and starts the vehicle. The device 5 can then be activated to scan the subsoil B even before the bucket of the earth-moving machine 1 touches the subsoil B. The topography, in this case the original terrain, is recorded passively. This means that no additional movements of the earth-moving machine are necessary to capture the topography, in particular that of the original terrain U.

Consequently, the earth-moving machine 1 does not have to drive over the (entire) subsoil at the beginning of the earth movements in order to scan it, but the detection takes place (immediately) before and during the earth-moving machine itself. This avoids empty runs of the earth-moving machine 1 purely to record the topography. A scan of the subsoil B, in this case the original terrain U, can be carried out before earth movements begin.

The vehicle sensors 3 are used to record all movements of the earth-moving machine 1 as it moves over the subsoil B. The detection can take place in relation to the local coordinate system (OKS) with zero point O. The zero point O can, for example, be in the center of the earth-moving machine 1. The position of the at least one topography sensor 2 in relation to the OKS can be mathematically calculated at any time from the data recorded by the vehicle sensors 3 arranged on the earth-moving machine 1. In this way, at least one corresponding 3D model of the subsoil is created not only before or at the start of the earth movements (original terrain), but also during the earth movements (actual terrain) and also at the end of the work (target terrain) of the earth-moving machine 1. The view in FIG. 2 can show an already completed target terrain or an intermediate stage before completion, then called actual terrain.

The corresponding 3D model of the subsoil (original, actual, target terrain) can be transferred from the OKS into a world coordinate system (WKS) W. For this purpose, one of the vehicle sensors 3 can be part of a global navigation satellite system, so that the data of the 3D models from the OKS can be uncalculated into the WKS using the current position of the earth-moving machine 1.

The device 5 can be set up in such a way that it evaluates the data recorded by the sensors 2, 3 (during operation of the earth-moving machine 1) and makes a corresponding comparison between the original terrain and the actual terrain, the original terrain and the target terrain or between two different actual terrains (e.g. one earlier and one later in time). This comparison can be used to draw conclusions about the volumes that delimit these terrains. In other words, the volume of the excavation from the excavation pit or the backfill on the subsoil B can be determined by means of the earth-moving machine 1 itself, i.e. while the earth-moving machine 1 is in use or in operation.

The working performance of the earth-moving machine 1 can then be determined from this data using the device 5. In addition to the volume of the excavation or backfill, this can also be done using the total recorded movements of the earth-moving machine 1.

Figure 3:
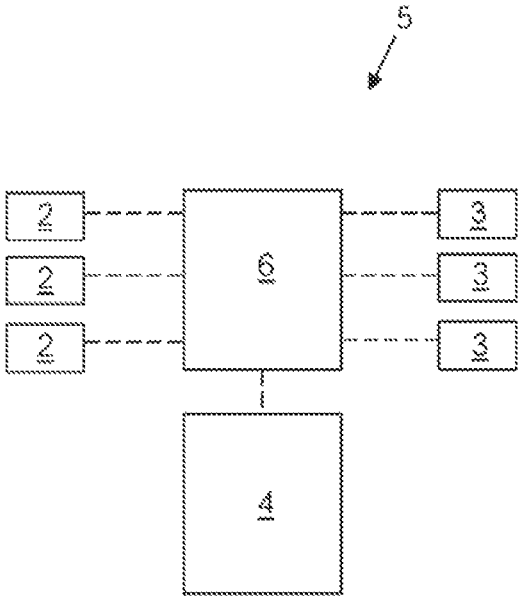
FIG. 3 is a schematic representation of a device according to the invention.

FIG. 3 shows a highly schematic and therefore not to scale representation of a possible embodiment of a device 5 according to the invention for carrying out the method according to the invention, as it may be arranged on the earth-moving machine 1 in FIG. 1 or 2. Three of the plurality of vehicle sensors 3 and also three topography sensors 2 are shown here. Of course, the number mentioned could vary. In particular, the lidar system with camera can have a different number of sensors and cameras. The topography sensors 2 and the vehicle sensors 3 can be connected (wired) or connectable (wireless) to the evaluation unit 4 via corresponding communication channels (wired or wireless), as indicated by the dashed lines. A communication unit 6 is arranged between the topography sensors 2, the vehicle sensors 3 and the evaluation unit 4. The values or data recorded by the topography and vehicle sensors 2, 3 can then be connected or connectable to the evaluation unit 4 via the communication unit 6, which comprises at least a transmitter and a receiver, in order to transmit them to the evaluation unit 4 or other earth-moving machines 1 located, for example, on the subsoil. In this way, the invention can be mounted on several, even different earth-moving machines 1 (e.g. wheel loaders, graders, excavators) so that the actual terrain can also be processed by several construction machines in real time and recorded as a 3D model. Especially on large construction sites, several earth-moving machines 1 then work together simultaneously. If two or more of the systems according to the invention are in use on a construction site, they can also work separately or together on a 3D model, in particular a point cloud or a polygon mesh. Two or more earth-moving machines 1 thus simultaneously and continuously create a large, common 3D terrain model (actual terrain) of the construction site. Technically, this is made possible by, for example, a constant data connection between the two earth-moving machines by means of the evaluation unit 4 or the communication unit 6 as well as the georeferencing of the two earth-moving machines 1 on the construction site. A further parameter is then stored in the 3D model as an attribute of at least one point of the point cloud or the polygon mesh, namely which point was measured by which machine, i.e. earth-moving machine 1.

The entire device 5 can be set up in such a way that it can be easily retrofitted to existing earth-moving machines 1. This is done by attaching the corresponding topography sensors 2 and the vehicle sensors 3 to the corresponding parts of the earth-moving machine 1, such as the joints of the booms. The evaluation unit can then be housed inside the earth-moving machine 1, for example, and connected to the topography sensors 2 and the vehicle sensors 3, e.g. by laying corresponding communication channels to them.

The invention can therefore be used to determine the working performance performed with the earth-moving machine to reshape the original terrain into the predetermined target terrain and thus indirectly the costs of the earth movements of such reshaping—in particular while the earth-moving machine is still in operation. In this way, the work carried out with the earth-moving machine can be recorded and billed more easily and with less effort than before. This can considerably simplify the billing of the working performance carried out with the earth-moving machine or the necessary costs.

REFERENCE SIGN

1 Ground-mounted device
2 Topography sensor
3 Vehicle sensor
4 Evaluation unit
5 Device
6 Communication unit
B Subsoil
I Actual terrain
S Target terrain
U Original terrain

The invention claimed is:

1. A method for detecting a working performance of an earth-moving machine within a subsoil, which comprises the following steps of:

a) detecting a topography of an original subsoil, being an original terrain, taken before or at a start of earth movements using the earth-moving machine;

b) detecting a changing topography of the subsoil, being an actual terrain, as a result of earth-moving operations during an execution of earth movements using the earth-moving machine;

c) carrying out step b) until a specified topography of the subsoil is reached, namely a target terrain;

performing a comparison test by:

d) comparing the original terrain with the actual terrain to detect the earth movements already carried out with the earth-moving machine; or e) comparing the original terrain with the target terrain to detect all the earth movements made with the earth-moving machine on the subsoil to create the target terrain; or f) comparing two different recorded actual terrains to detect the earth movements already made between them with the earth-moving machine;

g) determining the working performance of the earth-moving machine in dependence on the comparison from the step d) or e) or f);

h) detecting the original terrain or the actual terrain in the steps a) to c) by means of topography sensors which are attached to the earth-moving machine.

2. The method according to claim 1, which further comprises caring out the comparison in the step d) or e) or f) by calculating a volume which the original terrain bounds with the actual terrain or the original terrain bounds with the target terrain in a Cartesian coordinate system with a same zero point, so that the working performance is determined in dependence on a total volume of earth actually removed from the subsoil by means of the earth-moving machine or moved with it.

3. The method according to claim 1, wherein the original terrain, the actual terrain or the target terrain detected by means of the topography sensors is available as a polygon mesh or point cloud.

4. The method according to claim 3, wherein at least one predetermined point of the polygon mesh or of the point cloud is assigned at least one attribute which describes a property.

5. The method according to claim 1, which further comprises detecting movements of the earth-moving machine over the subsoil and movements of the earth-moving machine itself or parts thereof, by means of vehicle sensors.

6. The method according to claim 5, wherein detection of the movements of the earth-moving machine takes place during detection of the original terrain or the actual terrain.

7. The method according to claim 5, wherein the vehicle sensors are also attached to the earth-moving machine, so that the actual terrain is detected from different positions and orientations.

8. The method according to claim 1, wherein costs actually incurred by means of the earth-moving machine as a result of carrying out the earth movements are inferred from the working performance determined.

9. The method according to claim 3, wherein:

the topography sensors are cameras, 3D cameras, time-of-flight (TOF) cameras, or photonic mixer device (PMD) cameras, radar systems or lidar systems; and the polygon mesh or the point cloud is georeferenced.

10. The method according to claim 4, wherein:

the property is a property of the earth-moving machine, an identification of the earth-moving machine, an identification of the actual terrain, an identification of soil composition or rock classes of a volume of earth to be excavated or its color values, a time of recording, a measurement accuracy; and the at least one attribute being recorded by means of the topography sensors.

11. The method according to claim 5, wherein:

the parts of the earth-moving machine include booms;

the vehicle sensors are inclination sensors or position sensors, the vehicles sensors are mounted on the parts of the earth-moving machine; and the movements of the earth-moving machine are used to determine the working performance of the earth-moving machine.

12. The method according to claim 7, wherein the vehicle sensors and the topography sensors are attached to booms of the earth-moving machine.

13. A device for detecting a working performance of an earth-moving machine within a subsoil, the device comprising:

a plurality of topography sensors;

a plurality of vehicle sensors; and an evaluator connected or connectable to said topography sensors and said vehicle sensors, said evaluator being set up such that said evaluator carries out the method according to claim 1.

14. The device according to claim 13, wherein said evaluator is disposed or can be disposed outside the earth-moving machine and is connected or is connectable to said topography sensors and said vehicle sensors of the earth-moving machine via wireless communication channels.

15. The device according to claim 14, further comprising a communication unit having a transmitter and a receiver, wherein said topography sensors and said vehicle sensors are connected or are connectable to said evaluator via said communication unit, in order to transmit values recorded by means of said topography sensors and said vehicle sensors to said evaluator or further earth-moving machines via wireless communication channels.

16. The device according to claim 13, wherein:

said topography sensors are cameras, 3D cameras, time-of-flight (TOF) cameras, or photonic mixer device (PMD) cameras, radar systems or lidar systems;

said vehicle sensors are inclination sensors or position sensors; and said topography sensors and/or said vehicle sensors are mounted on parts of the earth-moving machine including a boom of the earth-moving machine.

17. An earth-moving machine, comprising:

the device for detecting the working performance according to claim 13.

18. The earth-moving machine according to claim 17, wherein the earth-moving machine is a stationary excavator.

19. The earth-moving machine according to claim 18, wherein the stationary excavator is a hydraulic excavator, a travelling excavator, a wheel loader, a backhoe loader, a crawler loader, a flat excavator, a bulldozer, a grader, or a dragline.

* * * * *